US005231705A

United States Patent [19]

Ragusa

[11] Patent Number: 5,231,705

[45] Date of Patent: Aug. 3, 1993

[54] METHOD AND APPARATUS FOR ELIMINATING TOILET ODORS

[76] Inventor: Peter Ragusa, 2404 Newton St., Orange, Tex. 77630

[21] Appl. No.: 856,466

[22] Filed: Mar. 24, 1992

[51] Int. Cl.[5] ..... E03D 9/052

[52] U.S. Cl. ..... 4/213; 4/347; 4/348; 4/352

[58] Field of Search ..... 4/213, 216, 217, 209 R, 4/306, 347

[56] References Cited

U.S. PATENT DOCUMENTS

| | | | |
|---|---|---|---|
| 2,181,510 | 11/1939 | Dahlke | 4/213 |
| 2,297,935 | 10/1942 | Baither | 4/213 |
| 3,579,650 | 5/1971 | Sloan | 4/347 |
| 3,585,651 | 6/1971 | Cox | 4/96 |
| 3,763,505 | 10/1973 | Zimmerman | 4/213 |
| 3,824,637 | 7/1974 | Hunnicutt, Jr. | 4/213 |
| 3,887,948 | 6/1975 | Stamper | 4/213 |
| 3,953,901 | 5/1976 | Poister et al. | 4/217 |
| 4,025,325 | 5/1977 | Goodwin, Jr. | 55/357 |
| 4,031,574 | 6/1977 | Werner | 4/216 |
| 4,059,857 | 11/1977 | Poister | 4/213 |
| 4,117,559 | 10/1978 | Boyle | 4/209 R |
| 4,168,553 | 9/1979 | Studer | 4/348 |
| 4,318,192 | 3/1982 | Williams et al. | 4/213 |
| 4,583,250 | 4/1986 | Valarao | 4/213 |
| 4,586,201 | 5/1986 | Todd, Jr. | 4/217 |
| 4,590,629 | 5/1986 | Lusk | 4/209 R |
| 4,864,664 | 9/1989 | Higgins | 4/213 |

*Primary Examiner*—Henry J. Recla
*Assistant Examiner*—Charles R. Eloshway
*Attorney, Agent, or Firm*—Pravel, Hewitt, Kimball & Krieger

[57] ABSTRACT

A system for removing unpleasant gaseous odors in a toilet having a bowl, a tank, and an overflow tube is disclosed. The system includes an air intake port located in the toilet bowl. A battery powered suction pump assembly contained in the tank is connected to the air intake port by a suction tubing. A charcoal filter is connected to the suction pump assembly. The suction pump assembly passes the odoriferous air through the charcoal filter prior to exhausting the filtered air into an exhaust tubing which releases the filtered air into the overflow tube. Also disclosed is a method of deodorizing gaseous odors and recirculating the deodorized air in a toilet having a bowl, a tank, and an overflow tube. Odoriferous air is sucked in and removed from the toilet bowl and then filtered and deodorized. The filtered and deodorized air is released into the overflow tube in the tank.

13 Claims, 2 Drawing Sheets

METHOD AND APPARATUS FOR ELIMINATING TOILET ODORS

BACKGROUND OF THE INVENTION

1. Field of the Invention

This invention relates to a method and apparatus for eliminating toilet odors.

2. Description of the Related Art

Various systems have been proposed for eliminating or removing odoriferous gases associated with flush toilets. Although this problem arising from a naturally occurring phenomenon has been with us for decades, there does not appear to be an odor removing system which has gained widespread acceptance in either commercial or residential applications.

Many of the prior art odor removing systems were add-on units for attachment to conventional toilets having the usual bowl, tank, pedestal, and folding lid and seat arrangements. Some of these odor removing systems included floor standing units or were highly visible when installed on the toilet. Examples of these types of systems are disclosed in U.S. Pat. Nos. 4,168,553; 4,117,559; 4,059,857; 3,824,637; and 3,585,651.

Preferably, the odor removing system should not require any floor supported components due to the space limitations present in many bathrooms. From a safety standpoint, the system should not present any electrical shock hazards. Furthermore, the system should be primarily concealed and not unsightly, have sanitary construction with easy to clean assemblies and a long service life.

Other systems were built into the toilet seat and the lid. U.S. Pat. No. 4,586,201 disclosed a seat and lid combination that attached to a conventional toilet in substitution for the conventional seat and lid. Such a system increases the size, weight and appearance of the combination lid and seat, thus making it slightly awkward and cumbersome.

None of the prior art devices have found any significant consumer acceptance. It is desirable to have a toilet odor eliminating apparatus which can be quickly and easily installed on a typical residential toilet and which is concealed, safe, easy to clean and has a long service life.

SUMMARY OF THE INVENTION

The odor removing system of the present invention is safe, simple, easy to install, almost totally concealed, easy to clean, and has a long service life. The system is adapted for use with a toilet having a bowl, a tank, and an overflow tube.

The system includes an air intake port located in the toilet bowl. A battery powered suction pump assembly contained in the tank is connected to the air intake port by a suction tubing. The suction pump assembly impels the odoriferous air through a charcoal filter prior to exhausting the filtered air into an exhaust tubing. The exhaust tubing releases the filtered air into the overflow tube which is in fluid communication with the toilet bowl. Thus, the air will continue to be recirculated through the odor removing system.

The system operates by sucking in odoriferous air from the toilet bowl and then filtering and deodorizing it in the tank. The filtered and deodorized air is then released into the overflow tube in the tank where it can be recirculated through the system.

BRIEF DESCRIPTION OF THE DRAWINGS

The objects, advantages and features of the invention will become more apparent by reference to the drawings which are appended hereto and wherein like numerals indicate like parts and wherein an illustrated embodiment of the invention is shown, in which.

DESCRIPTION OF THE PREFERRED EMBODIMENT

Figure 1:
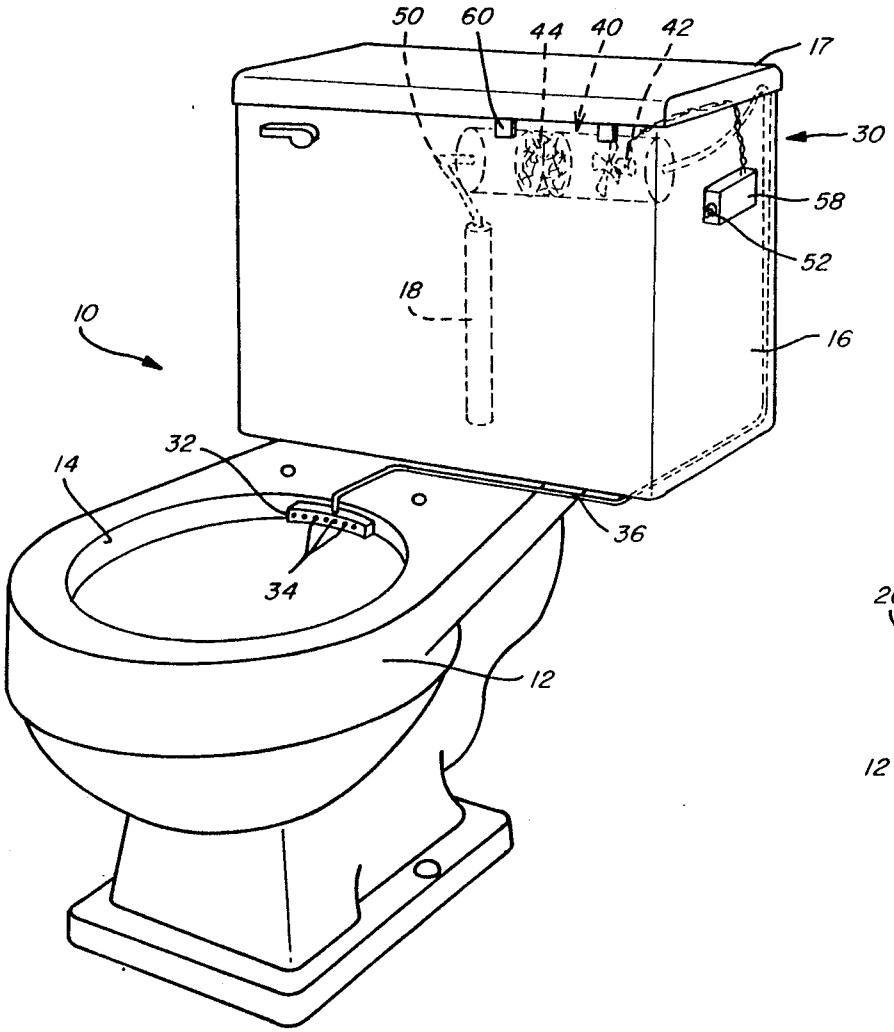
FIG. 1 is a perspective view of a typical toilet with the lid and seat removed for clarity purposes, the toilet having a bowl and tank and with the odor removal system of the present invention installed on the toilet.

FIG. 1 shows a typical toilet, designated generally as 10, including a bowl 12 having a rim 14 and a tank 16 mounted to the toilet bowl 12. A removable tank lid 17 rests on top of the tank 16. The tank 16 includes an overflow tube 18 which is mounted to the bottom of the tank 16. The overflow tube 18 is in fluid communication with the bowl 12. Thus, if the water level in the tank 16 rises above the upper end of the overflow tube 18, the excess water will overflow into the overflow tube 18 and be carried into the bowl 12 to prevent the tank 16 from overflowing.

Figure 2:
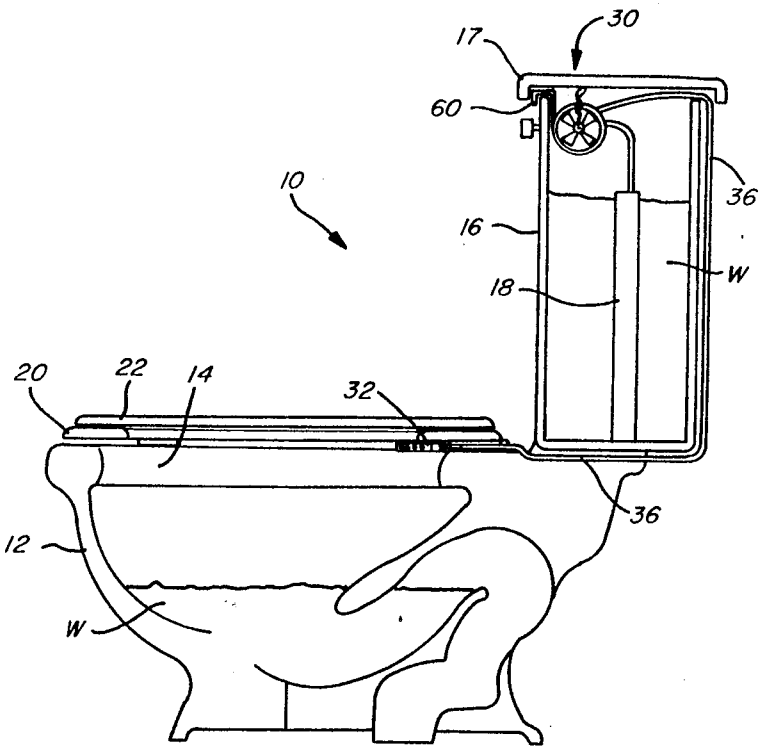
FIG. 2 is a cross sectional view of the typical toilet with the lid and seat in the closed position and the odor removal system as shown in FIG. 1.

Referring to FIG. 2, the toilet 10 is shown in cross section. FIG. 2 shows a seat 20 and a lid 22 in the lowered or closed position. In FIG. 1, the seat 20 and the lid 22 have been removed for clarity purposes. The water in the tank 16 and in the bowl 12 is designated generally as W.

It is to be understood that certain operating components of the toilet 10 have been omitted from the drawings for clarity purposes whereas certain other components have been shown and described in order to better understand the present invention.

Figure 3:
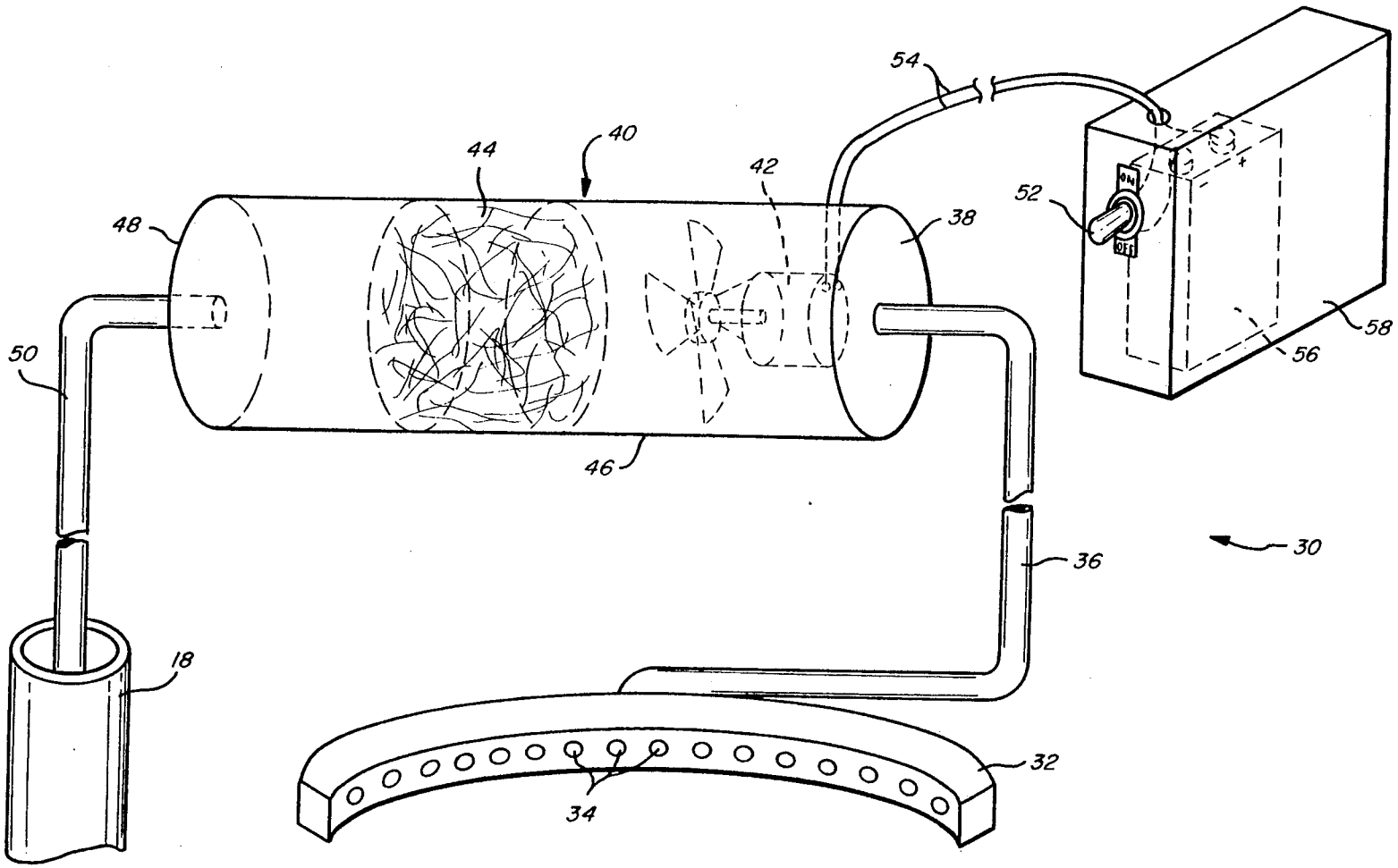
FIG. 3 is a view of the odor removal system of the present invention.

Referring to FIGS. 1 and 2, the odor removing system of the present invention, designated generally as 30, is shown installed on the toilet 10. FIG. 3 shows the various components forming the odor removing system 30. Referring to FIG. 3, the odor removing system 30 includes an air intake port 32 having a plurality of openings 34 which are in fluid communication with a port outlet (not shown). A flexible suction tube 36 has one end which is connected to the port outlet and a second end which is connected to an intake end 38 of a suction and filtering assembly, designated generally as 40.

The suction and filtering assembly 40 includes an air suction pump with motor and impeller 42 and a filter 44 contained in a housing 46. Preferably, the housing 46 is water-tight and has screwed on ends for accessing the filter 44 and suction pump assembly 42. The filter 44 is preferably a replaceable charcoal filter. The charcoal filter 44 may also be scented to give the filtered air a pleasant fragrance.

Opposite the intake end 38 of the suction and filtering assembly 40 is an exhaust end 48. The exhaust end 48 is connected to an exhaust tube 50 which has an open end which is inserted in the overflow tube 18. An on-off switch 52 is electrically connected to the air suction pump assembly 42 with electrical wires 54. Preferably, the air suction pump assembly 42 can be powered by a small battery 56, such as a 9 volt battery, as shown in FIG. 3.

INSTALLATION AND OPERATION

The installation and operation of the odor removing system 30 will now be explained with reference to FIGS. 1 and 2. In FIG. 1, the air intake port 32 is shown attached to the rear of the rim 14 of the bowl 12. The attachment can be accomplished with any of a variety of adhesives, adhesive backed materials or with generic hook and loop fabric attachments, as for example VELCRO fasteners. The air intake port 32 can alternatively be attached to the bottom surface of the toilet seat 20 as shown in FIG. 2 or can be attached to the upper surface of the rim 14 at the rear of the bowl 12.

In any of the above alternatives, the flexible suction tubing 36 is connected to the air intake port 32 and then passes beneath the seat 20 to the tank 16. The suction tubing 36 is preferably routed beneath the tank 16 and up the back of the tank 16. The suction tubing 36 is placed beneath the tank lid 17 and connected to the intake end 38 of the suction and filtering assembly 40. It may be necessary to slightly prop up the rear of the tank lid 17 to prevent the lid 17 from pinching closed the suction tubing 36 against the tank 16.

The suction and filtering assembly 40 includes a plurality of hooks 58 which hook onto the upper edge of the tank 16 and support the suction and filtering assembly 40. Preferably, the suction and filtering apparatus 40 is supported at a higher elevation than the upper end of the overflow tube 18 to maintain the suction and filtering apparatus 40 in a substantially dry condition. The exhaust tube 50 is connected to the exhaust end 48 of the suction and filtering assembly 40. The open end of the exhaust tube 50 is inserted in the overflow tube 18.

Preferably, the on-off switch 52 and the battery 56 are located on an exterior side of the tank 16. As shown in FIG. 1, the switch 52 and the battery 56 are mounted in a box 58 which can be attached to the tank 16 with VELCRO hook and loop fabric fasteners or adhesives. The switch 52 should be easily reachable by one using the toilet 10. The exterior mounting of the battery 56 also makes it extremely accessible when needing to replace the battery 56.

As can be readily seen and appreciated from the drawings, the odor removing system 30 is primarily concealed in the tank 16. The only portions of the system that are visible are the air intake port 32 (when the seat is raised), a short length of the suction tubing 36, and the box 58 containing the switch 52 and the battery 56.

In use, the user's anatomy serves to effectively seal off the upper opening of the toilet bowl 12. With the switch 52 turned on, the air suction pump assembly 42 sucks in the odoriferous air in the bowl 12 through the plurality of openings 34 in the air intake port 32 and through the flexible suction tubing 36. The odoriferous air is impelled through the charcoal filter 44. The filtered air is exhausted through the exhaust tubing 50 into the overflow tube 18 The overflow tube 18 is in fluid communication with the bowl 12. Thus, the air continues to be recirculated through the odor removing system 30 for more complete and effective filtering of the odoriferous gases. The recirculation provided by this system 30 has the added advantage that the filtered air is not emitted directly from the system into the surrounding area of the bathroom.

The foregoing disclosure and description of the invention are illustrative and explanatory thereof, and various changes in the size, shape and materials, as well as in the details of the illustrated construction, may be made without departing from the spirit of the invention.

I claim:

1. A system for removing unpleasant gaseous odors in a toilet including a bowl, a tank, and an overflow tube, the system comprising:

an air intake port adapted to be attached to the toilet bowl;

means for providing air suction contained in the tank;

a tubing connecting said air intake port to said means for providing air suction;

means for filtering unpleasant odors from the suctioned air; and means for recirculating the suctioned air back into the bowl.

2. The odor removing system of claim 1, wherein the toilet bowl has a rim and said air intake port is adapted to be attached to the rim.

3. The odor removing system of claim 1, wherein said means for providing air suction comprises a suction pump assembly.

4. The odor removing system of claim 3, wherein said suction pump assembly is battery powered.

5. The odor removing system of claim 1, wherein said means for filtering comprises a charcoal filter attached to means for providing air suction.

6. The odor removing system of claim 5, wherein said charcoal filter is scented and replaceable.

7. A system for removing unpleasant gaseous odors in a toilet including a bowl, a tank, and overflow tube, the system comprising:

an air intake port located on the toilet bowl;

means for providing air suction contained in the tank;

a tubing connecting said air intake port to said means for providing air suction;

means for filtering unpleasant odors from the suctioned air;

an exhaust unit connected to said means for filtering; and an exhaust tubing having a first end connected to said exhaust unit and a second end adapted to be inserted in the overflow tube, wherein the system sucks in air from the toilet bowl to said means for filtering via said air intake port, said tubing and said means for providing suction, and the air is exhausted through the exhaust unit and is recirculated into the bowl via said exhaust tubing and the overflow tube.

8. A system for removing unpleasant gaseous odors in a toilet including a bowl, a tank, and an overflow tube, the system comprising:

an air intake port adapted to be attached to the toilet bowl;

means for providing air suction contained in the tank;

a tubing connecting said air intake port to said means for providing air suction;

means for filtering unpleasant odors from the suctioned air;

means for recirculating the suctioned air back into the bowl; and a power switch adapted to be externally attached to the toilet.

9. The odor removing system of claim 8, wherein said means for providing air suction comprises a battery powered suction pump assembly.

10. The odor removing system of claim 8, wherein said means for filtering comprises a charcoal filter attached to means for providing air suction.

11. The odor removing system of claim 10, wherein said charcoal filter is scented and replaceable.

12. A method of deodorizing gaseous odors and recirculating the deodorized air in a toilet having a bowl, a tank, and an overflow tube, comprising the steps of:

sucking in the odoriferous air from the toilet bowl;

filtering and deodorizing the odoriferous air; and exhausting the filtered and deodorized air into the tank, wherein the exhausted air is exhausted into the overflow tube in the tank and the overflow tube is in fluid communication with the bowl.

13. The odor removing system of claim 7, further comprising a power switch adapted to be externally attached to the toilet.

* * * * *